US007679037B2

(12) United States Patent
Eden et al.

(10) Patent No.: US 7,679,037 B2
(45) Date of Patent: Mar. 16, 2010

(54) PERSONAL RIFLE-LAUNCHED RECONNAISANCE SYSTEM

(75) Inventors: Benjamin Z. Eden, Haifa (IL); Ronen Ben-Horin, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 913 days.

(21) Appl. No.: 10/539,340

(22) PCT Filed: Dec. 18, 2003

(86) PCT No.: PCT/IL03/01086

§ 371 (c)(1),
(2), (4) Date: Jun. 15, 2006

(87) PCT Pub. No.: WO2004/057263

PCT Pub. Date: Jul. 8, 2004

(65) Prior Publication Data

US 2008/0196578 A1 Aug. 21, 2008

(30) Foreign Application Priority Data

Dec. 19, 2002 (IL) ..... 153531

(51) Int. Cl.
*F42B 12/36* (2006.01)
*F42B 12/00* (2006.01)
*F42B 15/00* (2006.01)

(52) U.S. Cl. ..... 244/3.1; 89/1.11; 348/61; 348/143; 348/144; 348/148; 244/1 R

(58) Field of Classification Search ..... 244/1 R, 244/3.1–3.3; 89/1.11, 37.01, 41.01, 41.02, 89/41.05, 41.06, 41.17, 1.1; 455/91, 95, 455/98; 102/293, 430, 448, 458, 473, 501, 102/513; 348/61, 143, 144–148, 195, 207.99, 348/211.99, 211.1, 211.2, 211.4, 373, 266, 348/284

See application file for complete search history.

(56) References Cited

U.S. PATENT DOCUMENTS 3,721,410 A * 3/1973 Anspacher ..... 348/144

(Continued)

FOREIGN PATENT DOCUMENTS

DE 44 16 557 A1 11/1995

OTHER PUBLICATIONS

International Search Report under the parallel application, PCT/IL03/01086.

(Continued)

*Primary Examiner*—Bernarr E Gregory
(74) *Attorney, Agent, or Firm*—Arent Fox LLP

(57) ABSTRACT

A reconnaissance system includes a projectile having an opening through which images of a target area are acquired, a portable launcher having a mechanism for affixing the launcher to a rifle for launching the projectile to fly along and above the target area, an image acquiring device within the projectile for acquiring images of the target area through the opening, a transmitter within the projectile for transmitting during its flight the acquired images to a remote station, a stabilizing mechanism for stabilizing at least one of the projectile and the image acquiring device while flying in a ballistic trajectory above the target area and a remote station. The remote station includes a receiver for receiving the images transmitted from the projectile and a monitor having a display for displaying the received images.

16 Claims, 8 Drawing Sheets

U.S. PATENT DOCUMENTS

| | | | | | |
|---|---|---|---|---|---|
| 3,778,007 | A | * | 12/1973 | Kearney et al. | 244/3.14 |
| 3,962,537 | A | * | 6/1976 | Kearns et al. | 348/144 |
| 4,267,562 | A | * | 5/1981 | Raimondi | 348/144 |
| 4,543,603 | A | * | 9/1985 | Laures | 348/145 |
| 4,807,024 | A | | 2/1989 | McLaurin et al. | |
| 4,814,607 | A | | 3/1989 | Hofmann | |
| 5,355,767 | A | | 10/1994 | Morita | |
| 5,467,681 | A | * | 11/1995 | Liberman | 89/1.11 |
| 5,537,909 | A | * | 7/1996 | Schneider et al. | 89/1.11 |
| 5,537,928 | A | * | 7/1996 | Schneider | 102/293 |
| 6,056,237 | A | | 5/2000 | Woodland | |
| 6,510,776 | B2 | * | 1/2003 | Sirmalis et al. | 89/1.11 |
| 6,712,312 | B1 | * | 3/2004 | Kucik | 244/1 R |
| 6,880,467 | B1 | * | 4/2005 | Knapp | 102/513 |
| 6,924,838 | B1 | * | 8/2005 | Nieves | 348/211.99 |
| 6,978,717 | B1 | * | 12/2005 | Hambric | 102/473 |
| 7,174,835 | B1 | * | 2/2007 | Knapp | 102/513 |

OTHER PUBLICATIONS

Relevant extract from "Dynamics; 2nd Edition; J.L. Meriam and L.G. Kraige, John Wiley and Sons; 1987" ; Article 35, Problem 46/172; barely readable.

K. R. Crowell and C. T. Crowe; "Prediction of the lift and moment on a slender cylinder-segment wing-body combination"; Aeronautical Journal; p. 295-298; Jun. 1973.

D.E. Swanson and C. T. Crowe, "Cylindrical Wing-Body Configurations for Space-Limited Applications"; J. Spacecraft; vol. 11, No. 1; p. 60-61; Jan. 1974.

International Search Report under the parallel application, PCT/IL03/01086, 1998.

* cited by examiner

Moment Diagram @ center of gravity:

$$Mx = (h \sin\phi)\ (h \cos\psi) - (F \cos\phi)\ (F \sin\psi)$$

PERSONAL RIFLE-LAUNCHED RECONNAISANCE SYSTEM

CROSS-REFERENCE TO RELATED APPLICATION

This application is submitted under 35 U.S.C. 371 and claims priority to International Application No. PCT/IL2003/001086 filed Dec. 18, 2003, which claims priority to Dec. 19, 2002, the entire specification claims and drawings of which are incorporated herewith by reference.

FIELD OF THE INVENTION

The present invention relates to military intelligence gathering systems. More particularly, the invention relates to a personal system for rifle-launched reconnaissance.

BACKGROUND OF THE INVENTION

Gathering battlefield intelligence is a well-known problem in the art. On the one hand, intelligence is an essential component of the battlefield; on the other hand, there are obstacles to obtaining such information. The traditional means of gathering information about the battlefield involves dispatching a reconnaissance unit. However, the use of human reconnaissance involves risking not only the crew of the reconnaissance unit, but the entire squad, since the reconnaissance unit can be captured and interrogated by the enemy. Additionally, situations exist where a living person cannot gain physical access to a location where hostile activities take place.

It should be understood that the term "battlefield intelligence" is not meant to be limited to army activities only, but it encompasses all kind of situation in which hostile activities take place. These include, for instance, police activities directed against common criminals, terrorists, infiltrators, etc. Accordingly, all reference to intelligence, soldiers, battlefield, etc., apply mutatis mutandis also to such civil uses.

Nowadays, as the technology develops, better, less risk-laden solutions to this issue have been introduced. One of them is the Remotely Piloted Vehicle (RPV), which is an unmanned vehicle (usually—but not exclusively—an aircraft) controlled from a distant location through a communication link.

Other developments in this field deal with projectiles which comprise intelligence-gathering equipment launched from an artillery tube, such as disclosed in U.S. Pat. No. 3,962,537 and U.S. Pat. No. 5,467,681. The drawbacks of these inventions are the size and photography method involved. Regarding the size, according to these patents the projectile is launched from an artillery tube, thus causing logistic problems such as coordination with a canon battery, and hence these solutions are not suitable for the personal level, viz., situations in which individuals are in need of immediate intelligence but are not in contact with a suitable artillery support. Regarding the photography method, the camera is placed on a landing parachute, and hence it covers a circled area photographed from above, which involves targeting problems.

All the methods described above have not yet provided satisfactory solutions to the problem of gathering battlefield intelligence at the personal level.

It is an object of the present invention to provide a method and system for gathering battlefield intelligence, suitable for the use by an individual soldier, police officer, and the like.

It is another object of the present invention to provide a method and system for gathering battlefield intelligence which can be launched from a rifle independently operated and carried by an individual.

It is a further object of the present invention to provide a method and system for gathering battlefield intelligence, the operation of which is simpler than the methods of the prior art.

It is a still further object of the present invention to provide a method and system for gathering battlefield intelligence with a manufacturing cost appreciably lower than prior art methods and systems.

It is a still further object of the present invention to provide a method and system for gathering battlefield intelligence which can target "over the hill" or urban objects.

Other objects and advantages of the invention will become apparent as the description proceeds.

SUMMARY OF THE INVENTION

The invention relates to a reconnaissance system, comprising:

- A projectile, having an opening through which images of a target area can be acquired, said projectile being suitable to be launched from a portable launcher towards said target area, comprising image acquiring means for acquiring images of said target area through said opening and for transmitting said images to a remote station;
- Means for stabilizing said projectile and/or said image acquiring means while flying in a nearly-parabolic trajectory above said target area; and
- A remote station, for receiving and displaying said transmitted images, comprising a monitor for displaying said transmitted images.

According to a preferred embodiment of the invention the stabilizing means are vanes mounted on the rear side of said projectile. According to another preferred embodiment of the invention the stabilizing means are gyroscopic means that determines the orientation of said image acquiring means with respect to the projectile and the target area.

The image acquiring means can be of any suitable type and, for instance, is chosen from among optical camera, infrared camera, CCD and CMOS.

The images are transmitted to the remote station, preferably—but not limitatively—using RF transmission. According to a preferred embodiment of the invention the projectile comprises an antenna printed on its outer surface, thereby to maintain an aerodynamic outline of said projectile.

While this is not the most preferred mode of operation, it is possible to operate such that the projectile comprises and independent means of propulsion. According to a preferred embodiment of the invention, however, the projectile is pushed by a cartridge containing a charge in quantity that corresponds to the ballistic properties of said projectile and the distance from the launching point to the target.

In one preferred embodiment of the invention the portable launcher is coupled to a personal weapon. In another preferred embodiment of the invention the portable launcher is independent of a personal weapon.

The computing device used as the remote station, which receives the images transmitted by the projectile, can be of any suitable type. According to a preferred embodiment of the invention the computing device is selected from laptop computers, PDAs and Pocket PCs.

In yet another preferred embodiment of the invention the image acquiring means comprise two separate and distanced lenses whereby to generate three-dimensional images. In another preferred embodiment of the invention two separate cameras are used to increase the field of view without the disadvantage of decreased image resolution.

Three dimensional images can be obtained in a variety of ways well known to the skilled person, e.g., by using two separate cameras so positioned as to generate a stereoscopic image. According to another preferred embodiment of the invention the method employed is that described in copending Israeli Patent Application No. 150131, entitled "Stereoscopic Movie", and filed on Jun. 10, 2002 by the same applicant hereof.

As stated, it is necessary to stabilize the projectile such that the image-acquiring means face the area to be photographed. According to a preferred embodiment of the invention the means for stabilizing the projectile comprise retractable fins and wrap-around high wing.

The transmitter may transmit the images to one or more remote stations. In a preferred embodiment of the invention the images are transmitted together with a selection code that enables their reception only by predetermined stations.

While reference is made throughout this specification to image-acquiring means and image transmission, it will be appreciated by the skilled person that other data-acquiring apparatus can be employed in addition—or instead—of cameras. For instance, sensors that sense the presence of chemical and/or biological agents can be provided, together with signal-generating means to transmit to the user's receiving device a signal representative of the level or absence of such sensed chemical or biological agents. Other sensors and uses will be readily apparent to the skilled person, and are not discussed herein in detail for the sake of brevity, it being understood that the invention is meant to encompass all such alternative or equivalent sensors and systems.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

DETAILED DESCRIPTION OF PREFERRED EMBODIMENTS

The term "Rifle-Launched Reconnaissance System" (RLRS) refers herein to a system for gathering intelligence, launched by a launcher attached to a portable weapon.

The Photographed Area

Figure 1:
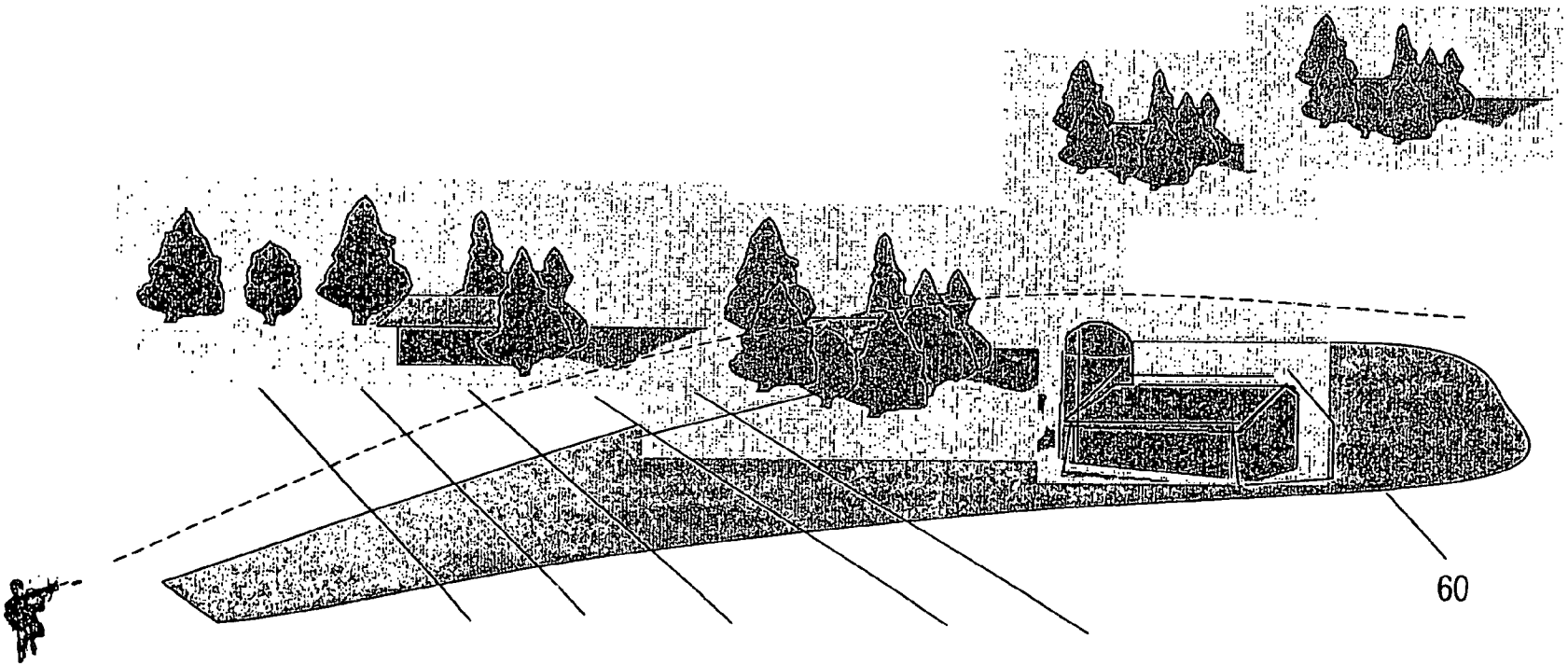
FIG. 1 schematically illustrates the projectile's course of a Rifle-Launched Reconnaissance System (referred to hereinafter as "RLRS"), according to a preferred embodiment of the invention.

FIG. 1 schematically illustrates the projectile's course of a RLRS, according to a preferred embodiment of the invention. In the prior art, due to the use of a parachute, the projectile must be shot in such a way that the parachute opens above the target area. According to the present invention, the course of the target area is flat, and hence, the photographed area is a strip along the projectile's course.

According to the invention, the camera mounted on the projectile starts to photograph from the launching point. Hence, the covered area 60 is typically a strip of 200-300 meters width, and 500-1000 meters length. By photographing from the launching point, easier focusing on a specific area is achieved in comparison with the prior art. Moreover, even the surrounding area of the launching point can be covered.

Since, as stated, prior art devices operate such that the launched camera is attached to a descending parachute, such prior art systems suffer from an objective difficulty in focusing on the desired area. As will be apparent to the skilled person, the invention solves this problem entirely.

Mobility

Figure 2:
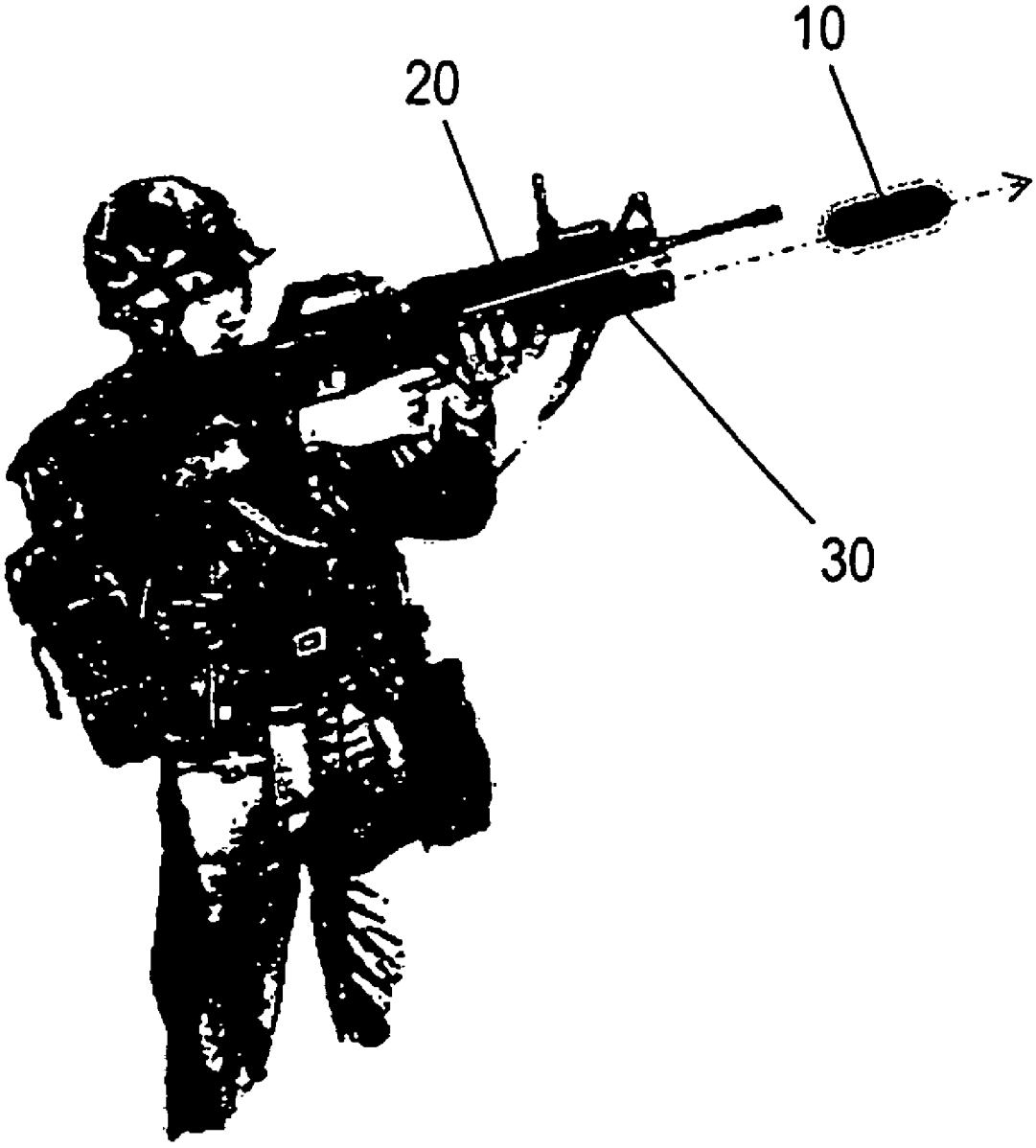
FIG. 2 schematically illustrates a soldier launching a projectile comprising part of a RLRS, according to a preferred embodiment of the invention.

FIG. 2 schematically illustrates a soldier launching a projectile comprising part of a RLRS, according to a preferred embodiment of the invention. The projectile 10 is launched from a grenade launcher 30 mounted on a rifle 20.

A major advantage of a RLRS is mobility. This is achieved by implementing standard equipment in the individual soldier level, and additional small components, which currently are available on the market:

- The launching mechanism is the grenade launcher, which is a part of the standard equipment of a soldier;
- The camera and the transmission equipment are mounted on a projectile. Thus, the projectile has the structure and size of a launchable suitable for the launching mechanism; and
- The monitor, which is a suitable hand-held computer available on the market, such as palm-pilot or the like PDA or portable computer.

Thus, the whole system is small enough to be easily portable and used by an individual soldier.

The Launching Mechanism

Figure 3:
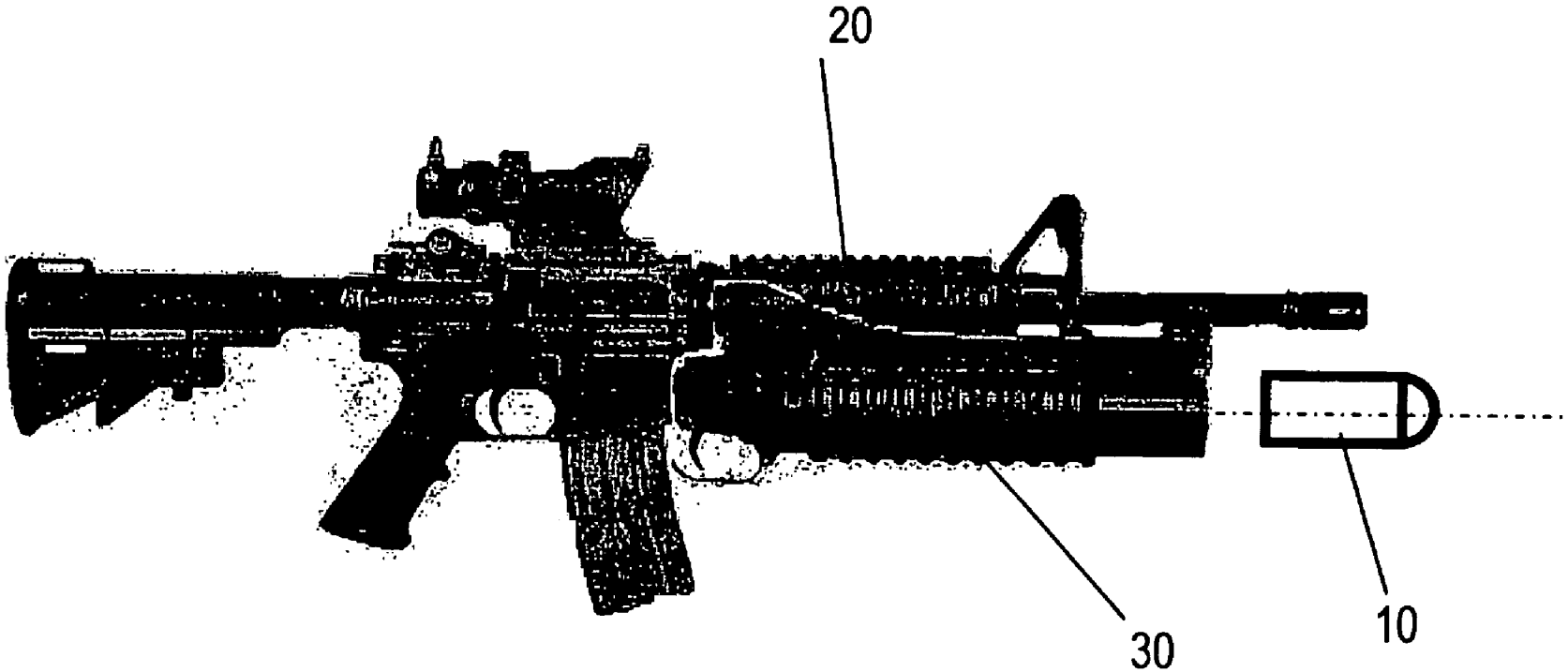
FIG. 3 schematically illustrates the launching mechanism of a RLRS, according to a preferred embodiment of the invention.

FIG. 3 schematically illustrates the launching mechanism of a RLRS, according to a preferred embodiment of the invention. The launching mechanism comprises the launcher 30, e.g. an M-203 launcher adapted for the M-16, and the rifle 20, on which the launcher is mounted, e.g. an M-16. The launched object is the projectile 10, which houses the photographic equipment.

Launching of a projectile being a part of a RLRS is carried out by inserting a projectile into the rifle's launcher, and then shooting the projectile towards/over the target area.

The rifle M-16 and grenade launcher are standard soldier's equipment in many army forces worldwide. However, it should be noted that on the market there are several grenade launchers that can be independently operated without a rifle.

Any such launcher can of course be used in conjunction with the invention, and is meant to be encompassed by the present invention.

The Projectile

Figure 4:
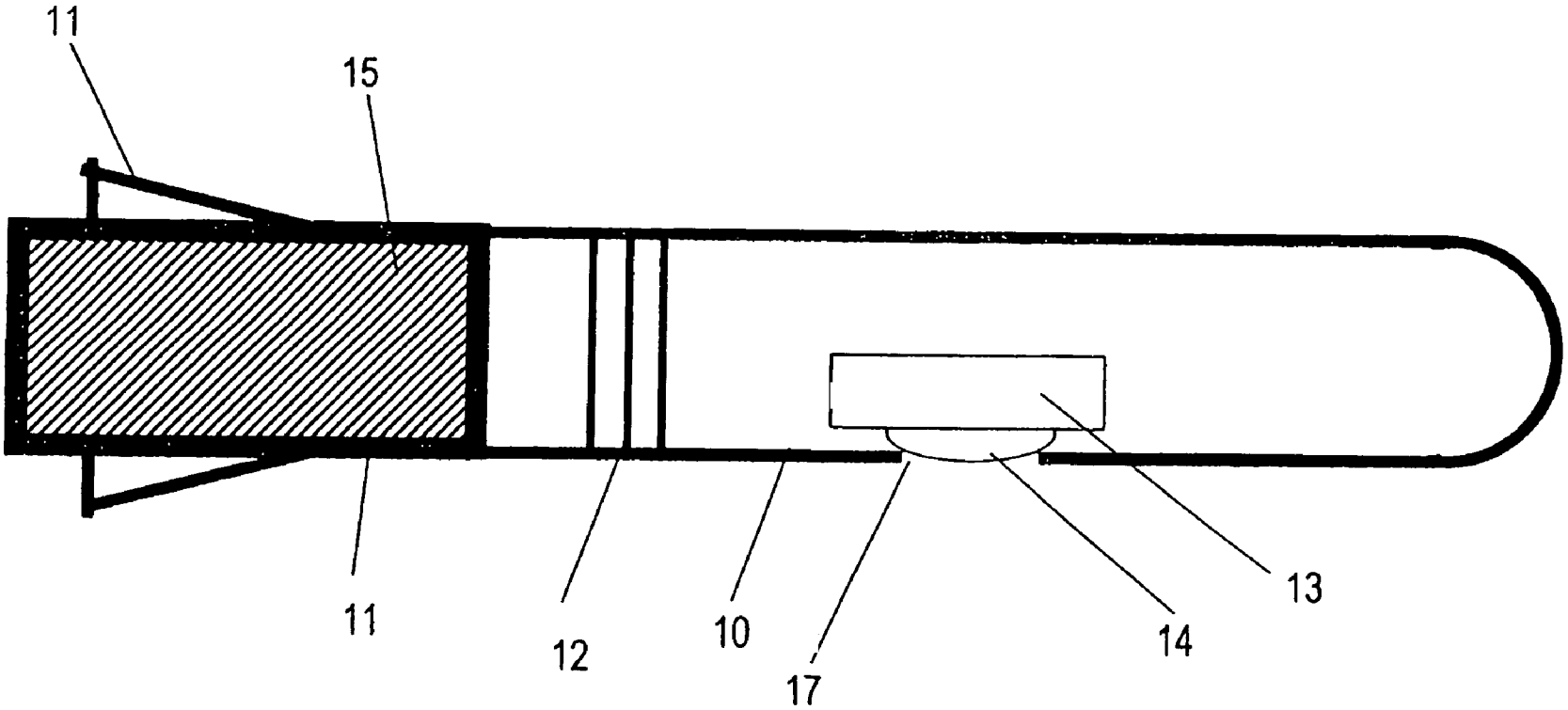
FIG. 4 schematically illustrates a projectile part of a RLRS, according to one embodiment of the invention.

FIG. 4 schematically illustrates a projectile part of a RLRS, according to a preferred embodiment of the invention. The purpose of the projectile is to bring a camera, e.g. the CCD 13 or a non-cooled IR detector, over a target area, to photograph the desired area and to display the captured images to the intended recipients, e.g. the soldier in the field, the command, etc. The images transmitted by the projectile may be received by more than one receiving device or, if desired, private codes may be provided such that only one predetermined device may receive the images. The projectile may take different flight courses, depending on the inclination of the gun from which it is ejected. However, typically the projectile flies in a nearly-parabolic trajectory. Hence, the camera should be turned toward the earth. Thus, the projectile has to stabilize in order to prevent spinning while over the target area.

It should be noted that the projectile leaves the launching device such that it possesses no spin. This is achieved by using an under-caliber projectile and a despinner, for instance, as described in *Dynamics 2nd Edition* [J. L. Meriam and L. G. Kraige, John Wiley and Sons, 1987].

The projectile comprises the following sub-systems:

The electro-optical sub-systems;

The propelling mechanism;

The stabilizing mechanism; and

The transmission sub-system.

The Electro-Optical Subsystem

The purpose of the electro-optical sub-system is to photograph the target area, and to convert it to digital form, for transmitting to a remote station.

The camera is the element that samples the input. It can be a video or stills camera, which samples images, or an infrared camera, which senses heat, or any other suitable image-acquisition device.

The simplest way to convey and display images captured by the camera is to convert the image seen through the lens to a digital format, which can be transmitted. For instance, this can be carried out by a CCD on which the image of the lens is reflected. Of course, there are other photographic means, such as infrared cameras, suitable for low visibility conditions.

A CCD (Charge-Coupled Device) is a light-sensitive integrated circuit that stores and sometimes displays the data for an image. Each pixel in the image is converted into an electrical charge the intensity of which is related to a color in the color spectrum. CCDs are now commonly included in digital still and video cameras. An alternative suitable device is a CMOS, which is also used in many devices to acquire images. As will be apparent to the skilled person, the particular type of image-acquiring device employed is not critical, and any suitable image-acquiring device, which can fit in the dimensions desired for a given projectile, can be used in the device of the invention.

The image quality of a CCD depends on the resolution of the CCD and the color depth—the higher the resolution, the better the quality of the image, the deeper the color depth, the better the quality of the image. Of course, the higher the resolution and the color depth, the higher its price. However, a CCD with a higher resolution and color depth than the image display will normally not be used, unless it is desired to display the images received by the portable image-receiving device, at a later time, on a display of higher quality.

Another feature of the CCD is its high degree of sensitivity. A good CCD can produce an image in extremely dim light, and its resolution does not deteriorate when the illumination intensity is low, as is the case with conventional cameras.

The signal can be either a video or stills pictures.

The electro-optical subsystem, as described in FIG. 4, comprises a miniature CCD 13, and a corresponding lens 14. During the flight of the projectile, the line of sight of lens 14 should be turned over the earth. The projectile comprises an opening 17, through which the camera can acquire images. In order to maintain the aerodynamic features of the projectile, the lens might be a part of the projectile's wall.

A suitable image-acquiring device is, for instance, the commercially available PC87XS color 4 mm CCD camera (ex Supercircuits, USA), which can be powered by a tiny battery, such as the Duracell Ultra CR2 Lithium/Manganese Dioxide Battery.

The Propelling Mechanism

The propelling power should typically enable carrying the projectile for 500-1000 meters. Since the Aerodynamics of projectiles is a subject well known in the art, it will not be discussed herein in detail, for the sake of brevity.

The Stabilizing Mechanism

The flight of the projectile should be stabilized such that the lenses of the camera are oriented toward the earth. As known to the skilled person, the stabilization can be carried out by, e.g., the vanes 11, which usually are placed on the rear part of the projectile. Those skilled in the art will appreciate that the camera can be directed over the earth by gyroscopic means.

The stabilizing vanes may be folded while the projectile is inserted inside the launcher, opening after the launch. In this way the projectile's diameter suits the launcher's diameter.

The designing of suitable wings is well known to the skilled person, and is therefore not described herein in detail. Many publications deal with the design of wings suitable for the invention. For instance, K. R. Crowell and C. T. Crowe, "Prediction of the lift and moment on a slender cylinder-segment wing-body combination", *Aeronautical Journal*, p. 295-298, June 1973, and D. E. Swanson and C. T. Crowe, "Cylindrical Wing-Body Configurations for Space-Limited Applications", *J. Spacecraft*, Vol. 11, No. 1, p. 60-61, January 1974, deal with these issues.

A Typical Operation of an RLRS

Figure 5:
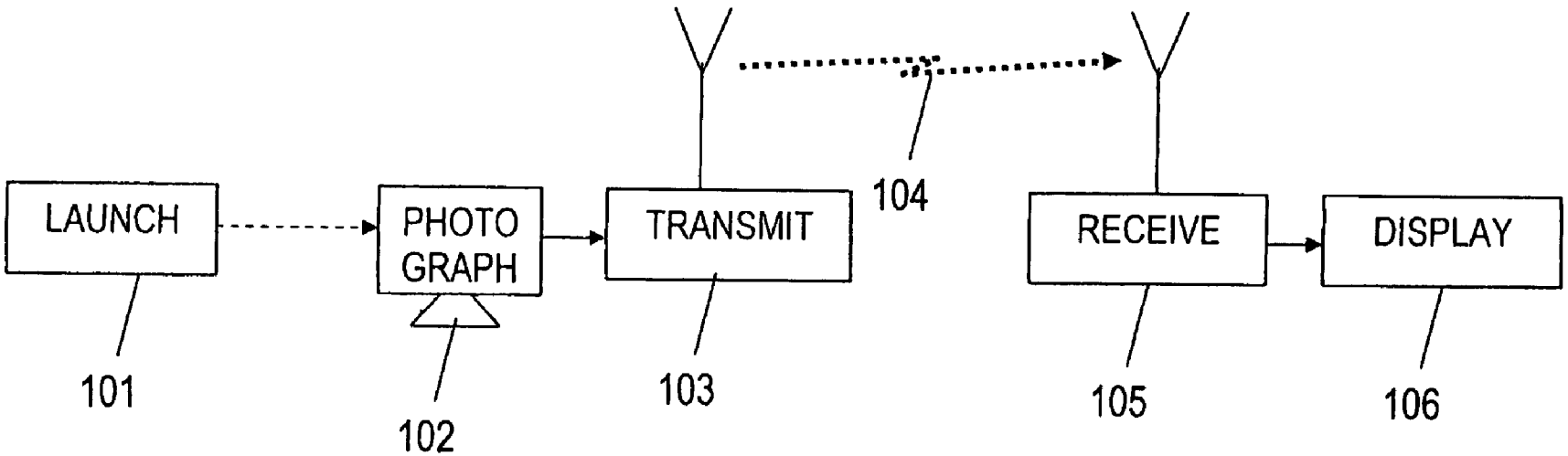
FIG. 5 schematically illustrates a block diagram of the operation of an RLRS, according to a preferred embodiment of the invention.

FIG. 5 schematically illustrates a block diagram of the operation of an RLRS, according to a preferred embodiment of the invention:

At 101, the projectile is launched towards/over a target area;

At 102, while the projectile is airborne, the camera inside is photographing;

At 103, the circuitry inside the projectile captures images photographed by the camera, and transmits them by a RF (Radio Frequency) transmission;

At 104, the RF transmission goes on-air;

At 105, the RF transmission is received by receiving equipment at the soldier's side;

At 106, the photographed images are displayed on the soldier's monitor.

It should be noted that the invention permits to enjoy a variety of existing sophisticated image-processing techniques. By using two cameras located at a distance, three-dimensional images or movies can be provided. Additionally, by employing a number of photographs taken sequentially it is possible to generate an image covering a large area.

The Transmission Mechanism

Figure 6:
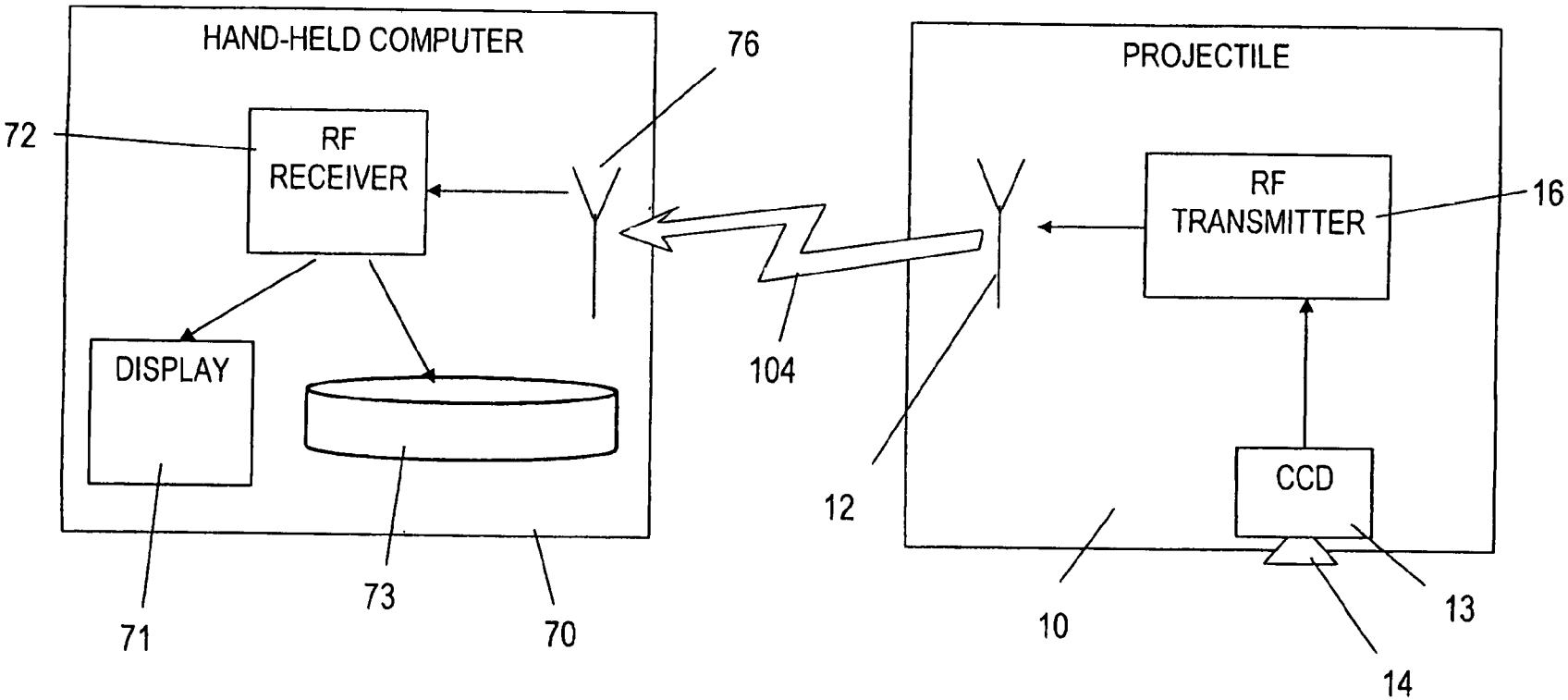
FIG. 6 schematically illustrates the electronic parts on a RLRS, according to a preferred embodiment of the invention.

FIG. 6 schematically illustrates the electronic parts on an RLRS, according to a preferred embodiment of the invention.

At the projectile 10 (FIG. 4), an image captured by the CCD 13 via the lens 14 is sent by the CCD 13 to the RF transmitter 16, and then transmitted by RF transmission to the hand-held computer 70.

The RF transmitter can be any suitable transmitter, e.g., a Mini Video Transmitter Model BA-1119, (manufactured by B. A. Microwaves Ltd., Israel). Additionally, any other type of transmission, such as by optical means, can of course be employed, and the invention is by no means limited to any particular type of transmission or transmitter.

At the hand-held computer 70, the transmission is received by the RF receiver 72, through the antenna 76. From the RF receiver the image may be presented by the display 71 of the hand-held computer 70, and stored at the storage media 73, in order to be displayed later.

Since the antenna 76 and the RF receiver are not an integral part of a typical hand-held computer, these components have to be added to the computer, and to be embedded into the computerized mechanism by an appropriate software.

The hand-held receiving device may be of any suitable type. Such devices are constantly developed and, therefore, any such device that may be used for the purposes of the invention is intended to be a part of the invention. For instance, PDAs combined with cellular phones, or pocket computers with radio transmission capabilities, which are currently under broad development, can of course be used for the purpose of the invention, once they reach the market. Illustrative and non-limitative examples of suitable receiving devices currently on the market are the iPAQ H3970 Pocket PC manufactured by Compaq, and the military PDA manufactured by Tadiran Ltd. (Israel). Of course, any suitable portable computer, such as a laptop computer, can be employed for the purposes of the invention.

As will be appreciated by the skilled person, the system and device of the invention present several important advantages:

The projectile is suitable for use with existing weapons;

The projectile leaves the weapon without spinning;

It does not require an independent propulsion system;

It is passively stabilized against rolling;

It can be operated by a single operator;

Does not require extensive training to operate;

Does not impede the movement of the operator;

It is disposable and relatively inexpensive;

It employs antennas which are built-in in the stabilizers (printed antennas);

It transmits to conventional portable computing devices;

It can display three-dimensional pictures and video;

It can provide a large, combined image, using a number of subsequent images;

It can approximate a location on the map, based on the knowledge of the trajectory;

It can carry a CCD, CMOS, IR or the like image-acquiring devices.

Example of a Typical RLRS

Figure 7A:
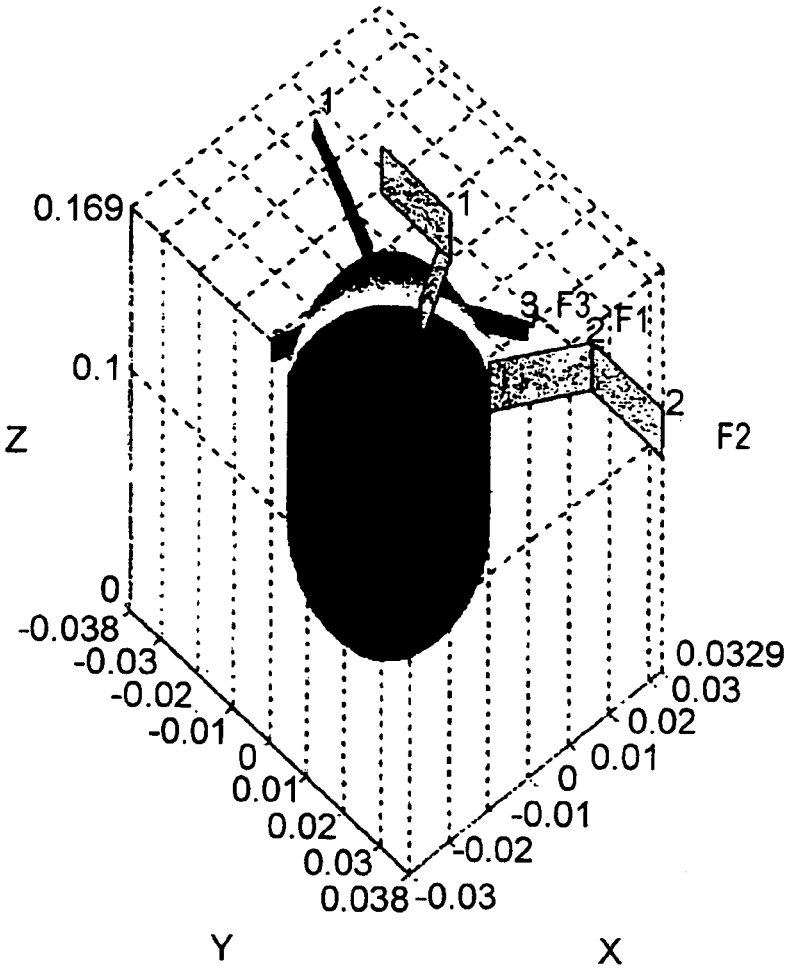
FIG. 7 illustrates a typical projectile, according to one preferred embodiment of the invention, in isometric view (FIG. 7A) and in side view (FIG. 7B)
Figure 7B:
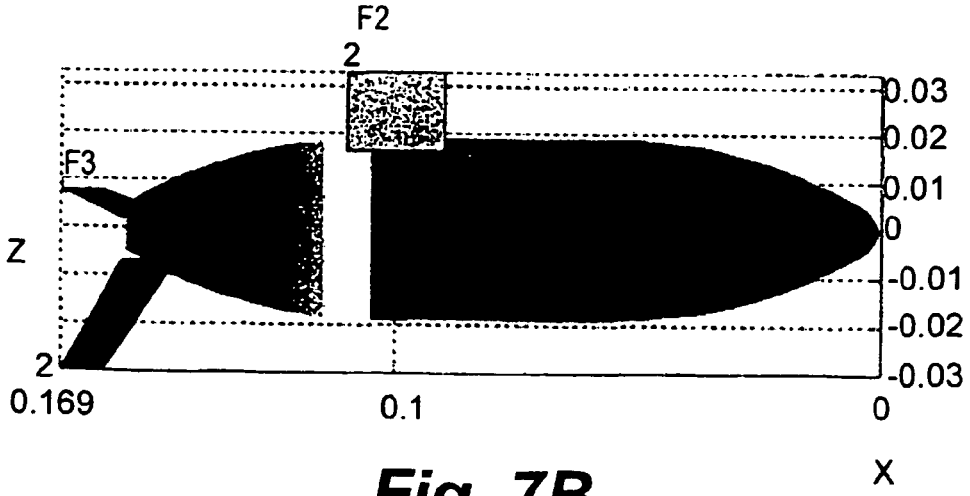

A typical RLRS will now be illustrated, with reference to FIGS. 7A and 7B. The various dimensions detailed hereinafter are given for the purpose of illustration only, and should not be taken as limiting the invention in any way. As will be appreciated by the skilled person, actual dimensions and parameters will be determined in each case according to the launching device employed and the performance required of the projectile.

The physical specifications for this example are:

L=155 mm (total length of the device)

Dmax=38 mm (maximum diameter)

Dbase=10 mm (base diameter)

m=150 gr (weight)

XCG=69 mm from nose (location of center of gravity).

The projectile of this example is to be launched in a folded configuration from the standard M-203 grenade launcher (M-16 rifle). The rocket is launched at an inclination of approximately 30 degrees, along a nearly-parabolic trajectory. The trajectory is not ballistic because a lifting force of 0.5-1 "mg" is desirable for assuring that the vertical symmetry plane be in the vertical direction.

The following are the desired operational specifications:

Initial velocity of 100 m/s

Range of 1000 m.

Maintain vertical orientation (cameras pointing downward–minimum rolling and pitching oscillations)

Maximum sensitivity to side winds–30 m maximum drift with 13 m/s cross wind.

Aerodynamic Configuration

The aerodynamic configuration for this example is shown in FIG. 7B (the wing is the computer model representation for the actual arc shaped wing). The configuration consists of:

Fuselage with ogival nose and boat-tail.

Circular arc shaped wings mounted high on the body. When folded, the wrap-around surfaces are conformal with the body.

Three tail fins (Y-arrangement, at angles of 75, 180 and 285 degrees), swept backward. Fins fold forward into the fuselage.

The pre-launch configuration with all surfaces folded, corresponds to the fuselage configuration alone.

The high wing has the purpose of giving the configuration an effective angle of attack, thus providing the specified lifting force. Moreover, the high wing assures that the center of pressure in the lateral (pitch) plane is located above the center of gravity. This, together with the lifting force, results in a restoring moment (gravity-driven) that acts to reduce any rolling motion that may develop. The possible causes of such rolling motion may be: side wind, yaw angle and velocity and launch-induced conditions.

The tail surfaces are sized and located at the specific circumferential angles in order to assure static aerodynamic stability in both the pitch and the yaw planes. The vertical bottom fin also acts to counteract the rolling moment induced by the high wing when the configuration is at a yaw angle or subjected to side wind. The pair of inclined fins can also be used (through mounting at a minus delta angle), if needed, to increase the angle of attack. This configuration is aerodynamically balanced in both the pitch and the yaw planes, with static stability margins of −0.31) and −0.1 D, respectively. The static stability in the pitch plane is essential for assuring stable trajectory. The present value is large enough to account for manufacturing tolerance, without being excessive. There is no clear reason for larger stability, as the center of pressure does not vary, due to narrow range of Mach numbers ($0.2<M<0.3$). Larger stability margin would imply larger fins, with the associated weight, drag and packaging penalties.

Within the yaw plane small static stability is desirable for similar reasons as quoted above. Zero stability (rocket maintains its original inertial angle when subjected to side wind)

may have the advantage of maintaining the desired camera angle, but the resulting side-slip angle may induce roll and consequently, larger side deviation. Main advantage of zero stability margin in the yaw plane is, however, preventing a powered configuration from pointing into the wind and consequently increasing the side deviation. Since the configuration is un-powered, it is preferred to provide small margin of static stability.

Within the lateral plane, the center of pressure is estimated to be 4 mm above the fuselage axis. In other words, the configuration experiences zero rolling moment about this location, when subjected to side slip (cross wind). In addition to the aerodynamic parameters that act to induce or damp the rolling moment, gravity acts indirectly to resist rotation and thus to maintain vertical orientation. The condition for this restoring moment to exist is the presence of a finite aerodynamic force component in the direction opposite to gravity, and an offset between the centers of gravity and pressure within the vertical symmetry plane.

Figure 8:
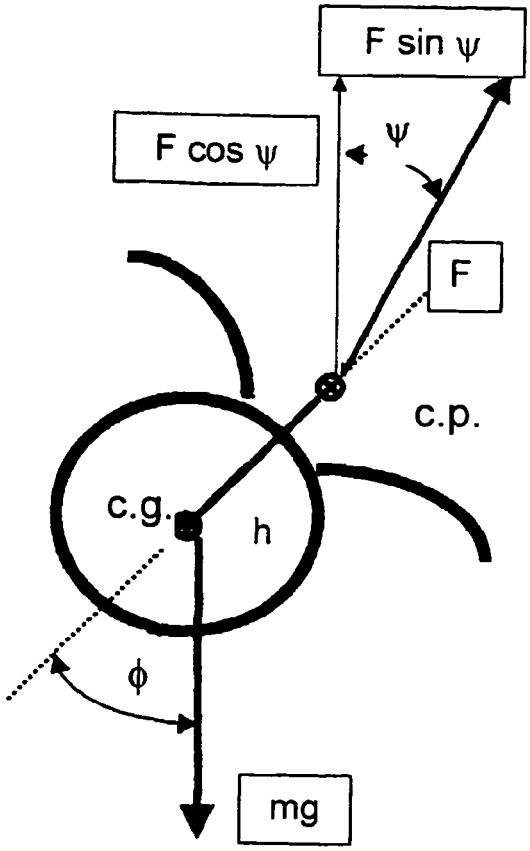
FIG. 8 is the force diagram for roll stabilization, for the projectile of FIG. 7.
Figure 8:
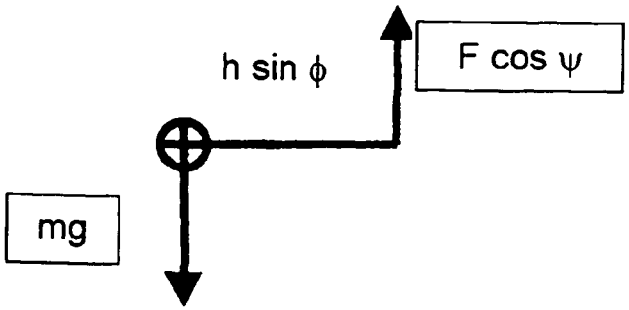

A force vector representation of the restoring moment is shown in FIG. 8. The restoring moment taken around the center of gravity, is written as follows:

$$Mx=(h \sin \phi)(h \cos \Psi)-(F \cos \phi)(F \sin \Psi)$$

where h=|ZCP−ZCG|

F=resultant total aero force normal to axis; Fz+Fy $\phi$=body roll angle $\Psi$=angle between force F and the gravity direction.

Thus a typical RLRS described above may comprise the following parts:

Launcher, e.g., M-203 grenade launcher;

Transmitting antenna, which is preferably a printed antenna;

RF transmitter;

Image acquiring device, e.g., a CCD;

Lenses;

Hand-held computer;

RF receiver.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A reconnaissance system, comprising:

a projectile having an opening through which images of a target area are acquired;

a portable launcher having means for affixing said launcher to a rifle for launching said projectile to fly along and above said target area;

image acquiring means within the projectile for acquiring images of the target area through said opening;

a transmitter within the projectile for transmitting during its flight said acquired images to a remote station;

means for stabilizing at least one of said projectile and said image acquiring means while flying in a ballistic trajectory above the target area; and a remote station, which comprises a receiver for receiving the images transmitted from the projectile, and a monitor comprising a display for displaying the received images.

2. The system according to claim 1, wherein said stabilizing means are vanes mounted on the rear side of said projectile.

3. The system according to claim 1, wherein said stabilizing means are gyroscopic means that determines the orientation of said image acquiring means with respect to the projectile and the target area.

4. The system according to claim 1, wherein the image acquiring means is selected from the group consisting of an optical camera, an infrared camera, a CCD and a CMOS.

5. The system according to claim 1, wherein the projectile transmitter comprises an antenna printed on the outer surface of the projectile, thereby maintaining an aerodynamic outline of said projectile.

6. The system according to claim 1, wherein the projectile is pushed by a cartridge containing a charge in quantity that corresponds to the ballistic properties of said projectile and the distance from the launching point to the target.

7. The system according to claim 1, wherein the launcher is coupled to a rifle and the launcher launches the projectile.

8. The system according to claim 1, wherein the launcher is detached from a rifle and independent thereof and the launcher launches the projectile.

9. The system according to claim 1, wherein the remote station is a portable computing device.

10. The system according to claim 9, wherein the computing device is selected from the group consisting of laptop computers, PDAs and Pocket PCs.

11. The system according to claim 1, wherein the image acquiring means comprise two separate and distanced lenses whereby to generate three-dimensional images.

12. The system according to claim 1, wherein the means for stabilizing the projectile comprises retractable fins.

13. The system according to claim 1, wherein the transmitter transmits the images to one or more remote stations.

14. The system according to claim 13, wherein the images are transmitted together with a selection code that enables their reception only by predetermined stations.

15. The system according to claim 1, wherein the launcher is a grenade launcher.

16. The system according to claim 15, wherein the rifle is an M 16, and the launcher is an M 203 grenade launcher.

* * * * *